US009417570B2

(12) United States Patent
Yamamoto

(10) Patent No.: US 9,417,570 B2
(45) Date of Patent: Aug. 16, 2016

(54) IMAGE FORMING APPARATUS AND CONTROL METHOD THEREOF

(71) Applicant: CANON KABUSHIKI KAISHA, Tokyo (JP)

(72) Inventor: Naohiro Yamamoto, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/757,532

(22) Filed: Dec. 23, 2015

(65) Prior Publication Data

US 2016/0116868 A1 Apr. 28, 2016

Related U.S. Application Data

(63) Continuation of application No. 14/525,283, filed on Oct. 28, 2014, now Pat. No. 9,261,829.

(30) Foreign Application Priority Data

Nov. 15, 2013 (JP) ..... 2013-237357

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/205; G03G 15/2078
See application file for complete search history.

(56) References Cited

U.S. PATENT DOCUMENTS

| | | | |
|---|---|---|---|
| 7,196,296 | B2 | 3/2007 | Yamamoto |
| 7,205,514 | B2 | 4/2007 | Suzuki et al. |
| 7,238,924 | B2 | 7/2007 | Kondo et al. |
| 7,268,326 | B2 | 9/2007 | Yamamoto et al. |
| 7,268,327 | B2 | 9/2007 | Yamamoto et al. |
| 8,099,008 | B2 | 1/2012 | Nakase et al. |
| 8,358,949 | B2 | 1/2013 | Nakase et al. |
| 8,606,160 | B2 | 12/2013 | Nakase et al. |
| 8,843,042 | B2 | 9/2014 | Nawa et al. |
| 8,843,046 | B2 | 9/2014 | Nawa et al. |
| 2011/0091230 | A1 | 4/2011 | Yamamoto |
| 2012/0328342 | A1 | 12/2012 | Takematsu et al. |
| 2013/0084092 | A1 | 4/2013 | Ooyanagi |
| 2014/0029992 | A1 | 1/2014 | Yamamoto |
| 2014/0286663 | A1 | 9/2014 | Yamamoto |
| 2014/0369707 | A1 | 12/2014 | Imine |
| 2015/0071669 | A1 | 3/2015 | Goda |

FOREIGN PATENT DOCUMENTS

JP 2000-242107 A 9/2000

*Primary Examiner* — Rodney Bonnette
(74) *Attorney, Agent, or Firm* — Fitzpatrick, Cella, Harper & Scinto

(57) ABSTRACT

To appropriately adjust the fixing temperature corresponding to the amount of applied toner, an image forming apparatus controls the temperature of a fixing unit configured to fix a recording material on a sheet. The apparatus acquires the amount of the recording material of each page in image data of a plurality of pages generated by dividing image data of one page, determines one fixing temperature using the acquired plurality of amounts of the recording material if a setting of dividing the image data of one page and printing the image data on a plurality of sheets is performed, and controls the temperature of the fixing unit using the determined fixing temperature.

8 Claims, 13 Drawing Sheets

FIG. 6

602

601

| | | | | | | | | | | | |
|---|---|---|---|---|---|---|---|---|---|---|---|
| 120 | 110 | 110 | 70 | 70 | 70 | 70 | 70 | 70 | 70 | 70 | 70 |
| 130 | 120 | 110 | 70 | 70 | 70 | 70 | 70 | 70 | 70 | 70 | 70 |
| 130 | 130 | 120 | 70 | 70 | 70 | 70 | 70 | 70 | 70 | 70 | 70 |
| 140 | 130 | 130 | 120 | 110 | 110 | 70 | 70 | 70 | 70 | 70 | 70 |
| 150 | 140 | 130 | 130 | 120 | 110 | 70 | 70 | 70 | 70 | 70 | 70 |
| 150 | 150 | 140 | 130 | 130 | 120 | 70 | 70 | 70 | 70 | 70 | 70 |

600a

603

| | | | |
|---|---|---|---|
| 120 | 70 | 70 | 70 |
| 140 | 120 | 70 | 70 |

600b

IMAGE FORMING APPARATUS AND CONTROL METHOD THEREOF

This is a continuation of U.S. patent application Ser. No. 14/525,283, filed on Oct. 28, 2014.

BACKGROUND OF THE INVENTION

1. Field of the Invention

The present invention relates to control of thermal fixation of a toner image formed by an electrophotographic method.

2. Description of the Related Art

The provisions of power saving and the like have recently becoming more strict, and image forming apparatuses are required to further reduce power consumption. That is, image forming apparatuses need to further reduce power consumption while maintaining a fixing temperature capable of reliably fixing an image. There is a technique of controlling the fixing temperature of a fixing unit in accordance with the amount of applied toner obtained from image data. Japanese Patent Laid-Open No. 2000-242107 (patent literature 1) discloses a method of determining whether input image data represents a photographic image or a character image, and when fixing a photographic image, making the fixing temperature of the fixing unit higher than that when fixing a character image. According to patent literature 1, the power consumption of the fixing unit can be reduced by adjusting the fixing temperature in accordance with the amount of applied toner representing image data.

An image forming apparatus has a poster printing function and a page division printing function. The poster printing function and the page division function are functions for printing input image data, which is intended to be output to one page, divisionally over a plurality of pages. For example, when printing input image data having an A4 size as an enlarged image having a double size (2×2) in the vertical and horizontal directions, the poster printing function prints it as image data in four (=2×2) pages each having the A4 size. The printed four pages are combined and used as an enlarged output image. On the other hand, for example, when printing input image data having an A4 size of 4-in-1 printing (also called 4-up printing) as an enlarged image having a double size (2×2) in the vertical and horizontal directions, the page division function prints it as image data in four (=2×2) pages each having the A4 size. In this case, four (=2×2) image regions formed as 4 in 1 in an A4 paper sheet are divisionally printed on 4 pages of A4 paper sheets.

However, to use the poster printing function or the page division printing function and control the fixing temperature, it is necessary to control the fixing temperature of each output page in accordance with the layout configuration of the output image to be printed. At the time of poster printing, the plurality of divided printed pages are continuous as image data or independent image data that are not continuous. On the other hand, at the time of page division printing, the plurality of divided printed pages are expected to be printed as independent image data. The above-described conventional technique does not consider the difference between the poster printing function and the page division function, and therefore fixing temperature control according to the image layout configuration is not appropriately performed.

SUMMARY OF THE INVENTION

According to one aspect of the present invention, an image forming apparatus for controlling the temperature of a fixing unit configured to fix a recording material on a sheet, comprises: an acquisition unit configured to acquire the amount of the recording material of each page in image data of a plurality of pages generated by dividing image data of one page; a determination unit configured to determine one fixing temperature using the plurality of amounts of the recording material acquired by the acquisition unit when a setting of dividing the image data of one page and printing the image data on a plurality of sheets is performed; and a control unit configured to control the temperature of the fixing unit using the fixing temperature determined by the determination unit.

According to another aspect of the present invention, an image forming apparatus for controlling the temperature of a fixing unit configured to fix a recording material on a sheet, comprises: an acquisition unit configured to acquire the amount of the recording material of each page in image data of a plurality of pages; a determination unit configured to determine the fixing temperature corresponding to the amount of the recording material of each page acquired by the acquisition unit; a determination unit configured to, when a setting of dividing the image data of one page and printing the image data on a plurality of sheets is performed, determine whether the difference of a plurality of fixing temperatures determined by the determination unit is not more than a predetermined value; and a control unit configured to control the temperature of the fixing unit using the fixing temperature determined by the determination unit when the determination unit determines that the difference is not more than the predetermined value.

The present invention provides a technique capable of appropriately adjusting a fixing temperature according to an amount of applied toner.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a view for explaining an applied toner amount detection method of the image forming apparatus;

DESCRIPTION OF THE EMBODIMENTS

Preferred Embodiments of the Present Invention will now be described in detail with reference to the accompanying drawings. Note that the following embodiments are merely examples and are not intended to limit the technical scope of the present invention.

(First Embodiment)

A tandem color image forming apparatus will be exemplified below as an image forming apparatus according to the first embodiment of the present invention.

<System Configuration>

Figure 1:
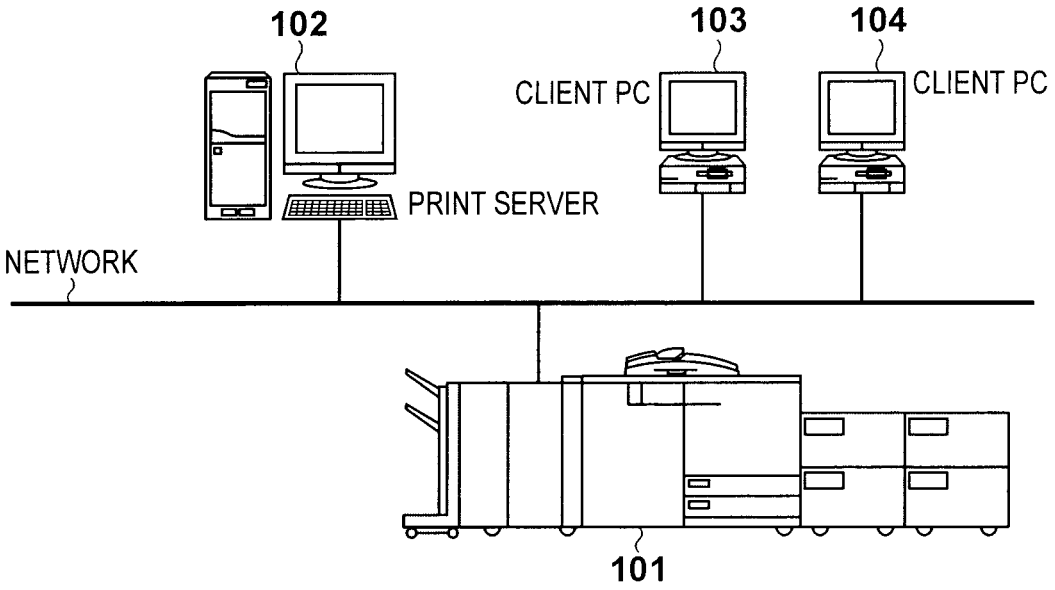
FIG. 1 is a view showing a system configuration including an image forming apparatus according to the first embodiment.

FIG. 1 is a view showing a system configuration including an electrophotographic image forming apparatus 101 according to the first embodiment.

The image forming apparatus 101 processes various kinds of input data, forms images on a printing medium (sheet) such as a paper sheet, and outputs a printed product. A print server 102 is connected to the image forming apparatus 101 via a network. Client PCs 103 and 104 are connected to the image forming apparatus 101 via the network, like the print server 102.

Figure 2:
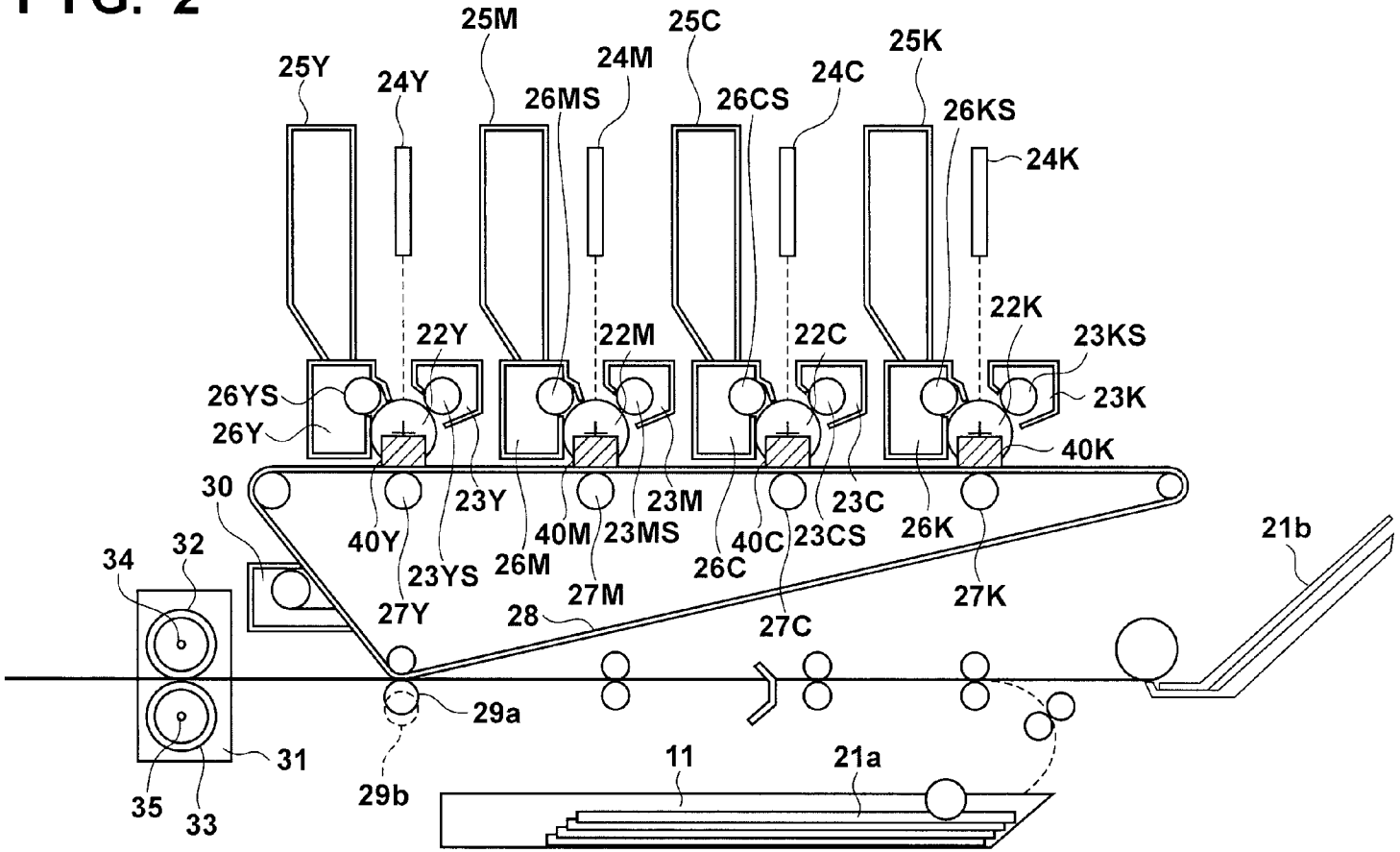
FIG. 2 is a sectional view of a tandem color image forming apparatus.

FIG. 2 is a sectional view of the tandem color image forming apparatus 101. The tandem color image forming apparatus 101 performs image formation by transferring a toner image onto a recording medium 11 via an intermediate transfer material 28.

A charging unit includes photosensitive members 22Y, 22M, 22C, and 22K, and four charge injectors 23Y, 23M, 23C, and 23K configured to charge the respective photosensitive members for yellow (Y), magenta (M), cyan (C), and black (K).

The photosensitive members 22Y, 22M, 22C, and 22K rotate upon receiving driving forces transmitted from driving motors 40Y, 40M, 40C, and 40K, respectively. Referring to FIG. 2, the driving motors rotate the photosensitive members 22Y, 22M, 22C, and 22K, respectively, counterclockwise in accordance with an image forming operation.

An exposure unit irradiates the photosensitive members 22Y, 22M, 22C, and 22K with exposure light using scanner units 24Y, 24M, 24C, and 24K, and selectively exposes the surfaces of the photosensitive members 22Y, 22M, 22C, and 22K. Electrostatic latent images are thus formed on the photosensitive members.

A developing unit includes four developers 26Y, 26M, 26C, and 26K that perform development for Y, M, C, and K to visualize the electrostatic latent images on the photosensitive members. The developers are provided with sleeves 26YS, 26MS, 26CS, and 26KS, respectively. Note that the developers 26 are detachable.

A transfer unit transfers a single-color toner image from each photosensitive member 22 onto the intermediate transfer material 28. In FIG. 2, the intermediate transfer material 28 rotates clockwise. The single-color toner images are sequentially transferred onto the intermediate transfer material 28 as the photosensitive members 22Y, 22M, 22C, and 22K and primary transfer rollers 27Y, 27M, 27C, and 27K located on opposing sides rotate. This is called primary transfer. Note that when an appropriate bias voltage is applied to the primary transfer roller 27, and the photosensitive member 22 and the intermediate transfer material 28 are caused to have different rotation speeds, the single-color toner image can efficiently be transferred onto the intermediate transfer material 28.

The transfer unit also overlays the single-color toner images on the intermediate transfer material 28, and conveys the overlaid multicolor toner image to secondary transfer roller, whose different positions are denoted as 29*a* and 29*b* in FIG. 2, as the intermediate transfer material 28 rotates. In addition, the recording medium 11 (sheet) such as a paper sheet is conveyed from a paper feed tray to the secondary transfer roller in a sandwiched state, and the multicolor toner image on the intermediate transfer material 28 is transferred onto the recording medium 11. At this time, an appropriate bias voltage is applied to the secondary transfer roller, and the toner image is electrostatically transferred. This is called secondary transfer. The secondary transfer roller contacts the recording medium 11 at the position 29*a* during transfer of the multicolor toner image onto the recording medium 11, and separates from the recording medium 11 to the position 29*b* after printing processing.

A fixing unit is a functional unit that fuses and fixes, to the recording medium 11, the multicolor toner image transferred onto the recording medium 11. For this purpose, the fixing unit includes a fixing roller 32 that heats the recording medium 11, and a pressurizing roller 33 that presses the recording medium 11 against the fixing roller 32. The fixing roller 32 and the pressurizing roller 33 are formed to be hollow and incorporate heaters 34 and 35, respectively. A fixing device 31 causes the fixing roller 32 and the pressurizing roller 33 to convey the recording medium 11 holding the multicolor toner image, and applies heat and pressure, thereby fixing the toner to the recording medium 11.

Note that a temperature sensor (not shown) is attached to the fixing unit, and the fixing unit is controlled to perform a fixing operation only when a temperature sufficient for fixing is confirmed. After that, the recording medium 11 after toner fixing is discharged to a discharge tray (not shown) by a discharge roller (not shown), and the image forming operation ends.

A cleaning unit 30 cleans toners remaining on the intermediate transfer material 28. Waste toner of the different colors remaining after the four-color toner image formed on the intermediate transfer material 28 is transferred onto the recording medium 11 is removed from the intermediate transfer material 28 by cleaning and stored in a cleaner container.

<Arrangement of Image Forming Apparatus>

Figure 3:
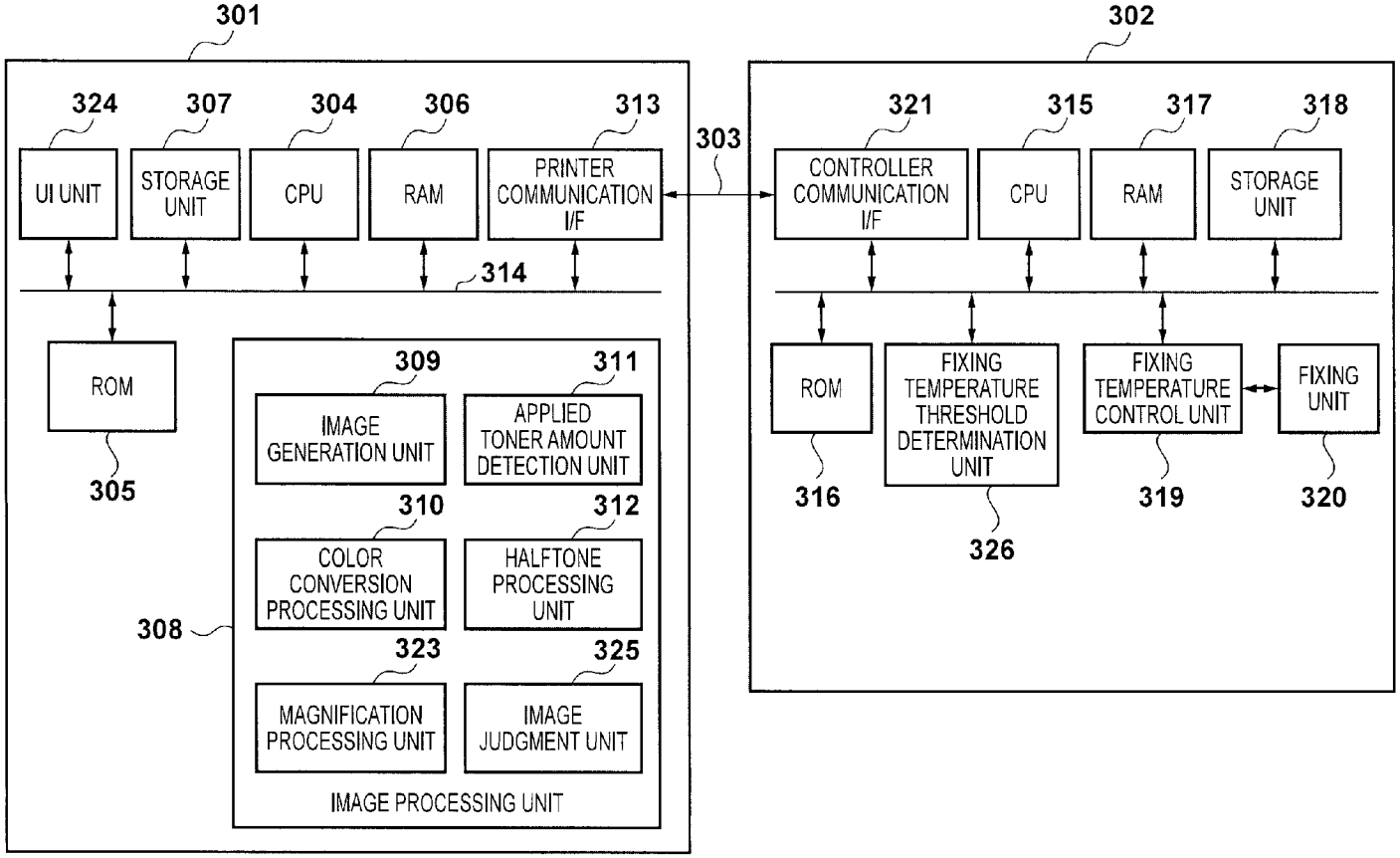
FIG. 3 is a block diagram of the arrangement of the image forming apparatus.

FIG. 3 is a block diagram of the arrangement of the image forming apparatus 101. The image forming apparatus 101 is roughly divided into a controller unit 301 and a print unit 302. The controller unit 301 is a functional unit that receives print data from an external apparatus and generates image data (raster image data) to be provided to the print unit 302. The print unit 302 is a functional unit that forms an image on a recording medium such as a paper sheet based on the image data received from the controller unit 301.

Each of the controller unit 301 and the print unit 302 includes a CPU configured to execute programs, a ROM, and a RAM. Each CPU reads out a main program from the ROM and stores it in the RAM in accordance with an initial program stored in the ROM. The RAM is used to store programs or as the main memory for work.

An image generation unit 309 generates printable raster image data based on print data (print job) received from, for example, a computer apparatus (not shown) that is an external apparatus. The raster image data includes RGB data and attribute data representing the data attribute of each pixel. The image generation unit 309 may handle image data read by a reading unit (scanner) installed in the image forming apparatus 101 itself. The reading unit here can be a CCD (Charged Couple Device) reading unit or a CIS (Contact Image Sensor) reading unit. A processing unit that performs predetermined image processing for the read image data may also be provided. The image forming apparatus 101 may be configured to receive image data from an external reading unit via an interface (not shown), instead of including the reading unit in itself.

A user interface (UI) unit 324 is a functional unit that accepts, for received print data, the information of a print request from the user. The user designates, via the UI unit 324, the layout configuration of image data to be printed. The UI unit 324 includes a selection unit that selects a poster printing function or a page division printing function. Using the information of the print request received by the UI unit 324, the image forming apparatus 101 performs fixing temperature control to be described later.

Figure 4:
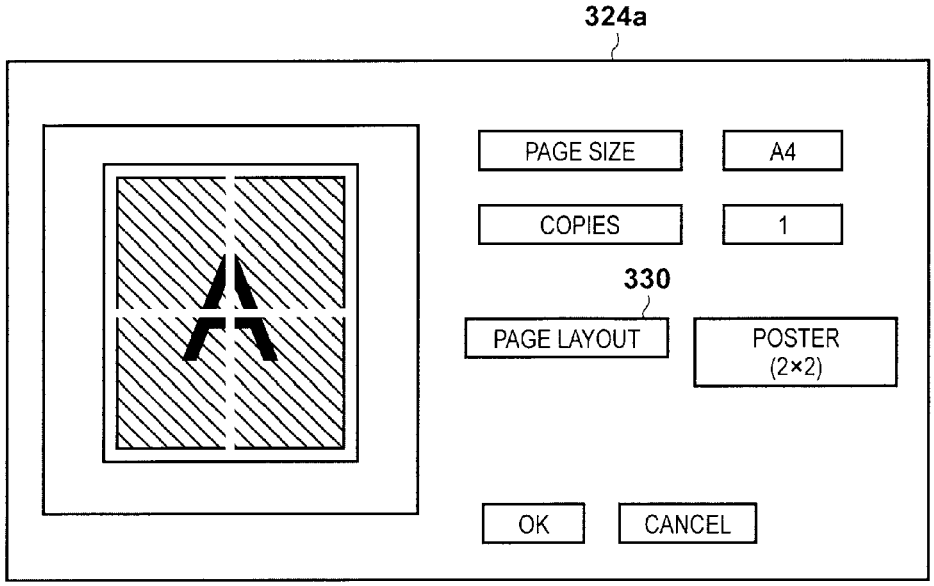
FIG. 4 is a view for explaining a user interface screen for printout settings when a poster printing function is selected.

FIG. 4 is a view for explaining a user interface screen 324*a* for printout settings when the poster printing function is selected. The poster printing function is a function of enlarging one input image and printing it on a plurality of recording media for which a predetermined arrangement is designated. A page layout button 330 selects the page configuration of an image to be output in correspondence with an input image. For example, the user can select "poster (2×2)" from a plurality of preset layouts by pressing the page layout button 330. In this case, the image forming apparatus 101 enlarges one input image to double in size in both the main scanning direction and the sub-scanning direction and divisionally prints it on four pages.

Figure 5:
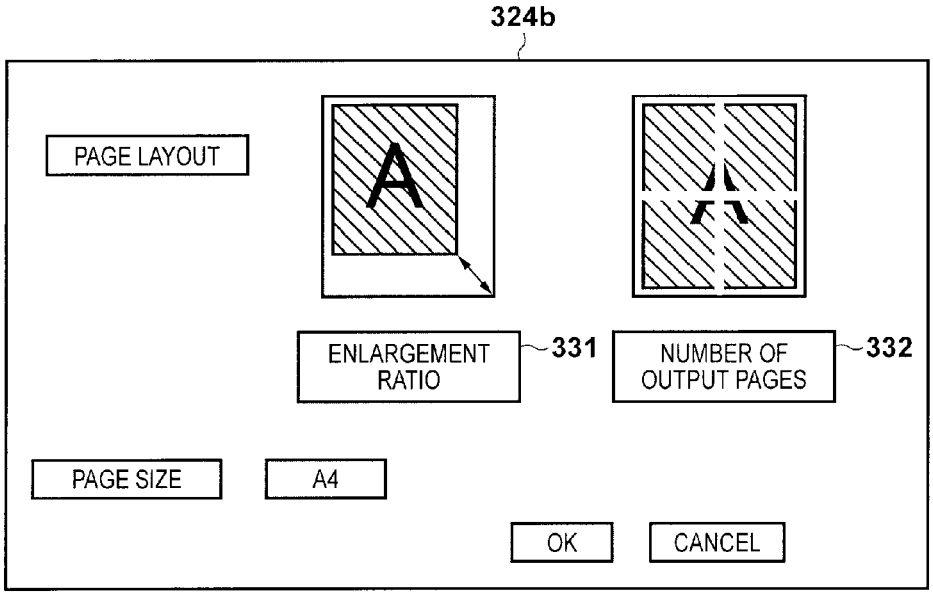
FIG. 5 is a view for explaining a user interface screen for printout settings when a page division printing function is selected.

FIG. 5 is a view for explaining a user interface screen 324*b* for printout settings when the page division printing function is selected. An enlargement ratio setting button 331 sets the enlargement ratio of an output image with respect to an input image. A number-of-output-page setting button 332 is a functional unit that selects a page configuration used to output an output image. For example, the user can set the number of output pages for page division by pressing the number-of-output-page setting button 332 (acceptance unit).

The information of the print request set by the user interface screen 324*a* or 324*b* serving as the UI unit 324 is sent to a CPU 304 and used for fixing temperature control to be described later. Note that the user interface screens 324*a* and 324*b* may be displayed on the client PCs 103 and 104.

A magnification processing unit 323 performs magnification processing of image data expressed by RGB or CMYK. A color conversion processing unit 310 converts RGB data into CMYK in accordance with the toner colors, and generates CMYK data and attribute data. At this stage, the image data represents the toner amounts of CMYK, and is expressed by, for example, values of 0 to 255 (8-bit value) on a pixel basis. For example, if the values of all colors are "0", this represents disuse of toners. The larger the value of the toner amount, the higher the density. A value "255" represents the highest density.

An applied toner amount detection unit 311 detects (derives) the amount of applied toner from the CMYK data generated by the color conversion processing unit 310. A detailed applied toner amount detection method will be described later with reference to FIG. 4. The applied toner amount detection unit 311 sends the CMYK data that has undergone the applied toner amount detection and the attribute data to a halftone processing unit 312. In addition, at the time when applied toner amount detection of the processed image data has ended, the applied toner amount detection unit 311 holds the applied toner amount information of the processed image data in association with the corresponding image data. The held applied toner amount information is read out by the CPU 304.

An image judgment unit 325 reads the image attribute of an input image from the data of the input image, and determines the image configuration of the input image data in each page. The image attribute represents, for example, whether character or image data exists in the input image. For example, it is determined whether the input image has an image configuration as one continuous page or is an N-in-1 image including N individual images to be arranged in one page. To determine the configuration of an input image, a method of determining a character or an image in the input image is usable. Concerning a target pixel of interest, it is determined by referring to the pixel data of peripheral pixels whether the pixel of interest is the pixel of an isolated dot or the pixel of one of continuous dots. It is then determined based on the determination result whether the pixel of interest is character data, image data, an isolated point, or an invalid pixel region where no pixel information is recorded at all.

The CPU 304 calculates attribute information and a minimum fixing temperature necessary to fix for each page to be printed based on the printout information of image data set from the UI unit 324, the information of the image determination result of the image judgment unit 325, and applied toner amount information from the applied toner amount detection unit 311. The method of calculating the minimum fixing temperature necessary to fix the toner image will be described later with reference to FIG. 8. The attribute information of each page to be printed is attribute information used to determine a case where the poster printing function is designated for the printout determined by the UI unit 324.

The halftone processing unit 312 performs halftone processing for each of the CMYK data output from the applied toner amount detection unit 311. As a detailed arrangement, the halftone processing unit performs screen processing or error diffusion processing. In the screen processing, N-ary processing is performed using a plurality of predetermined dither matrices and input image data. In the error diffusion processing, N-ary processing is performed by comparing input image data with a predetermined threshold, and the difference between the input image data and the threshold at that time is diffused to peripheral pixels to be subsequently subjected to N-ary processing.

A printer communication I/F unit 313 and a controller communication I/F unit 321 are I/F units configured to perform communication between the controller unit 301 and the print unit 302. Information to be communicated here includes various kinds of control signals and minimum temperature information necessary for fixing as well as image data (raster image data) to be printed. A fixing temperature control unit 319 controls the temperature of a fixing unit 320 based on temperature information (for example, minimum temperature information necessary for fixing) received from a CPU 315.

A fixing temperature threshold determination unit 326 determines the maximum threshold of the fluctuation width of the fixing temperature of each page to be printed based on the information of the fixing temperature and the attribute information determined by the CPU 304. The determined threshold information of the maximum fluctuation width of the fixing temperature is sent to the CPU 315. The CPU 315 determines the fixing temperature based on the information of the fixing temperature and the threshold information of the fixing temperature. The determined fixing temperature information is sent to the fixing temperature control unit 319. The method of determining the fixing temperature by the CPU 315 will be described later.

<Applied Toner Amount Detection>

FIG. 6 is a view for explaining the applied toner amount detection method of the image forming apparatus 101. Note that in the following explanation, an amount of applied toner is expressed as a ratio (unit: %) to the maximum value of the toner weight per unit area as 100%. For each color on a pixel basis, a value "255" corresponds to an amount of applied toner of 100%. The sum of the amounts of applied toners of CMYK represents the amount of applied toner of the pixel.

For example, when two colors each having the maximum value (100%) are overlaid, the amount of applied toner of the pixel is 200%. Note that each color has tonality and can take a value within the range of 0% to 100%. For example, in an image that makes full use of four CMYK toners in a full-color print mode, the maximum amount of applied toner is large. On the other hand, for example, in a monochrome image using K toner alone, the maximum amount of applied toner is smaller.

Upon receiving CMYK data (raster image data) generated by the color conversion processing unit 310, the applied toner amount detection unit 311 calculates the necessary amount of applied toner for each pixel. An image 600*a* represents part of image data to be processed by the applied toner amount detection unit 311. A minimum unit indicated by reference numeral 601 represents one pixel. Reference numeral 602 indicates a pixel block of 3×3 pixels. A numerical value shown in each pixel of the image 600*a* represents the amount of applied toner of the pixel detected by the applied toner amount detection unit 311.

The applied toner amount detection unit 311 calculates the average value of the amounts of applied toner in each pixel block of 3×3 pixels. The average value in each pixel block is calculated because the temperature necessary for fixing an image often depends on not the amount of applied toner of each pixel but a toner amount in a predetermined range in general. For this reason, the average value in each pixel block is calculated here. However, the minimum value and maximum value in a pixel block may be used. Note that an image 600*b* is obtained by calculating the average value of the amounts of applied toner in each pixel block of the image 600*a*. A numerical value inscribed in each pixel block represents the average value of the amounts of applied toner in the pixel block.

When calculation of the average value of the amounts of applied toner in a processed pixel block has ended, the applied toner amount detection unit 311 holds the amount of applied toner having the maximum value among all pixel blocks of the processed image data as the applied toner amount information of the target page.

<Fixing Temperature Determination Based on Amount of Applied Toner>

As described above, an amount of applied toner means a toner amount per unit area of an image. To fix toner on a recording medium without any fixing failure, the temperature of the fixing unit needs to be set to a fixing temperature capable of reliably fixing a pixel (or pixel block) whose amount of applied toner has the maximum value in the target page. Since the maximum amount of applied toner changes depending on image data to be printed, the temperature necessary for fixing also changes between image data. More specifically, the larger the maximum amount of applied toner, the higher the necessary temperature.

Figure 7:
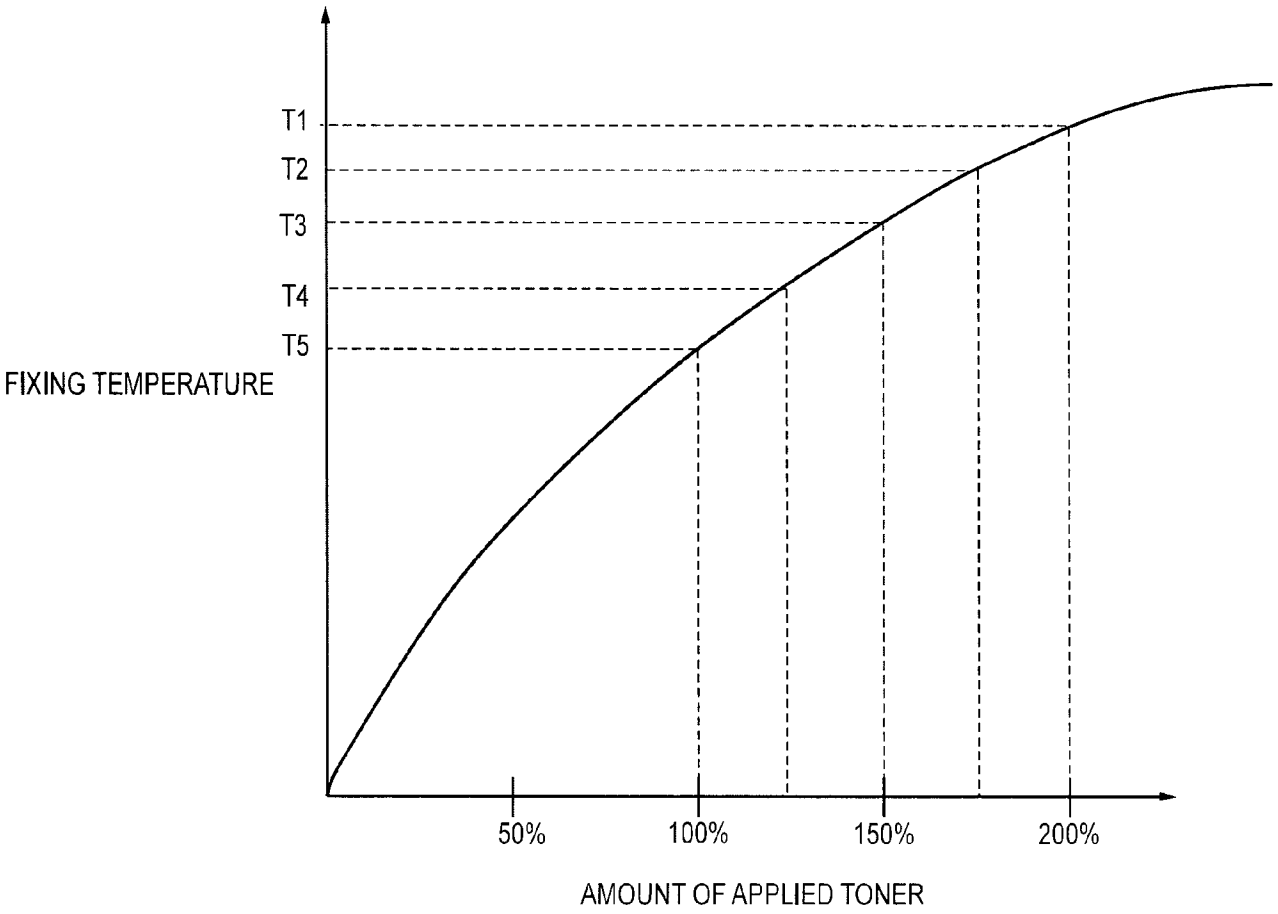
FIG. 7 is a graph showing the relationship between an amount of applied toner and a fixing temperature.

FIG. 7 is a graph showing the relationship between the amount of applied toner and the fixing temperature. The abscissa represents the amount of applied toner, and the ordinate represents the temperature necessary for fixing. For example, when the detection result of the applied toner amount detection unit is 200%, the minimum temperature necessary for fixing is T1. When the detection result is 100%, the minimum temperature necessary for fixing the target page is T5, as can be seen.

If the temperature has risen to the temperature capable of fixing the maximum amount of applied toner appearing in a print page, no problem such as a fixing failure occurs in the whole image. It is therefore possible to obtain the minimum temperature necessary for fixing a page to be output based on the applied toner amount information detected by the above-described applied toner amount detection unit.

Note that since the relationship (relationship data) shown in the graph of FIG. 7 is stored in a storage unit 307 or a RAM 306 as, for example, a lookup table (LUT) because it is used in temperature control of the fixing unit.

<Operation of Image Forming Apparatus>

Figure 8:
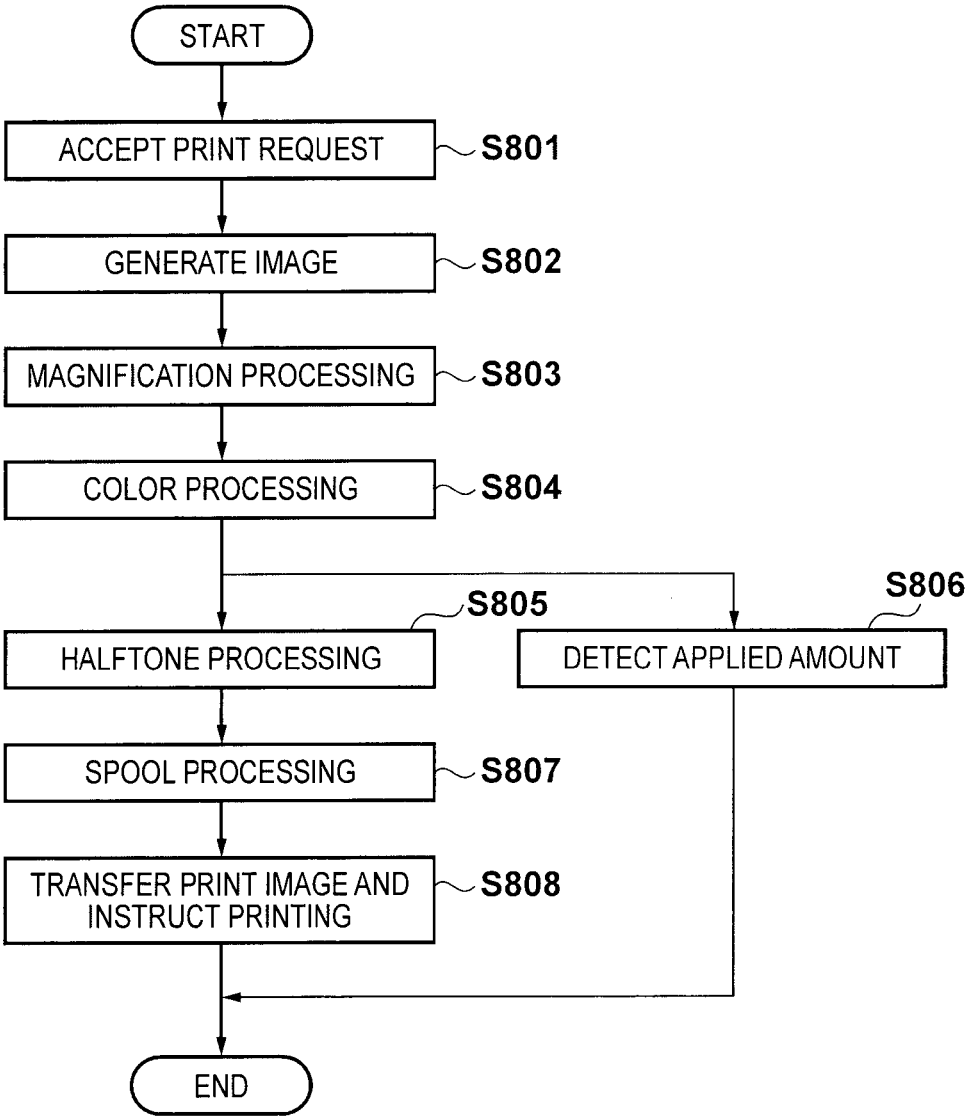
FIG. 8 is a flowchart for explaining image processing in a controller unit.

FIG. 8 is a flowchart for explaining image processing in the controller unit 301. In particular, the processing sequence of applied toner amount detection characteristic to the first embodiment will be described. The procedure shown in FIG. 8 is implemented by causing the CPU 304 to execute a control program and operate an image processing unit 308.

In step S801, the UI unit 324 accepts a print request from the user. In step S802, the image generation unit 309 generates raster image data from print data. As described above, RGB data and attribute data representing the data attribute of each pixel are output on a pixel basis as the raster image data.

In step S803, the magnification processing unit 323 performs magnification processing of the image as needed. The magnification processing includes poster printing processing and page division processing. For example, when poster-printing one input image as an output image having a 2×2 layout configuration, the size of the input image needs to be enlarged.

In step S804, the color conversion processing unit 310 converts the RGB data into CMYK in accordance with the toner colors, and generates CMYK data and attribute data.

In step S805, the halftone processing unit 312 performs halftone processing (N-ary processing) for the CMYK data by a method using screen processing or error diffusion processing.

In step S806, the applied toner amount detection unit 311 detects the amount of applied toner based on the CMYK data. This processing may be executed in parallel to the halftone processing of step S805. Note that the applied toner amount detection is performed here because the amount of applied toner can be calculated more accurately by performing applied toner amount detection for CMYK data that is a continuous tone image than by performing applied toner amount detection for a halftone image. The amount of applied toner may be calculated from an image after halftoning, as a matter of course.

In addition, the applied toner amount detection is performed here by a method using all the YMCK colors. For this reason, if the applied toner amount detection is performed after halftone processing, the temporarily separated YMCK colors need to be collected. When performing the applied toner amount detection by hardware, hardware to read out the separated YMCK colors or a buffer configured to collect the YMCK colors is needed. To avoid this, the applied toner amount detection is performed here in step S806.

In step S807, the CPU 304 performs spool processing of temporarily storing the result of halftone processing in step S805 in the RAM 306. Note that when executing poster printing processing or page division processing out of the magnification processing, the image data of each page is stored in step S807 based on the image layout configuration of printout to be enlarged. For example, when executing poster printing in a 2×2 size, output image data after magnification corresponding to four pages is spooled for the processes of steps S802 to S806.

In step S808, the CPU 304 transmits the image data (image data after halftone processing) to the print unit 302 via the printer communication I/F unit 313 and a communication line 303.

<Fixing Temperature Control Based on Amount of Applied Toner>

Figure 9:
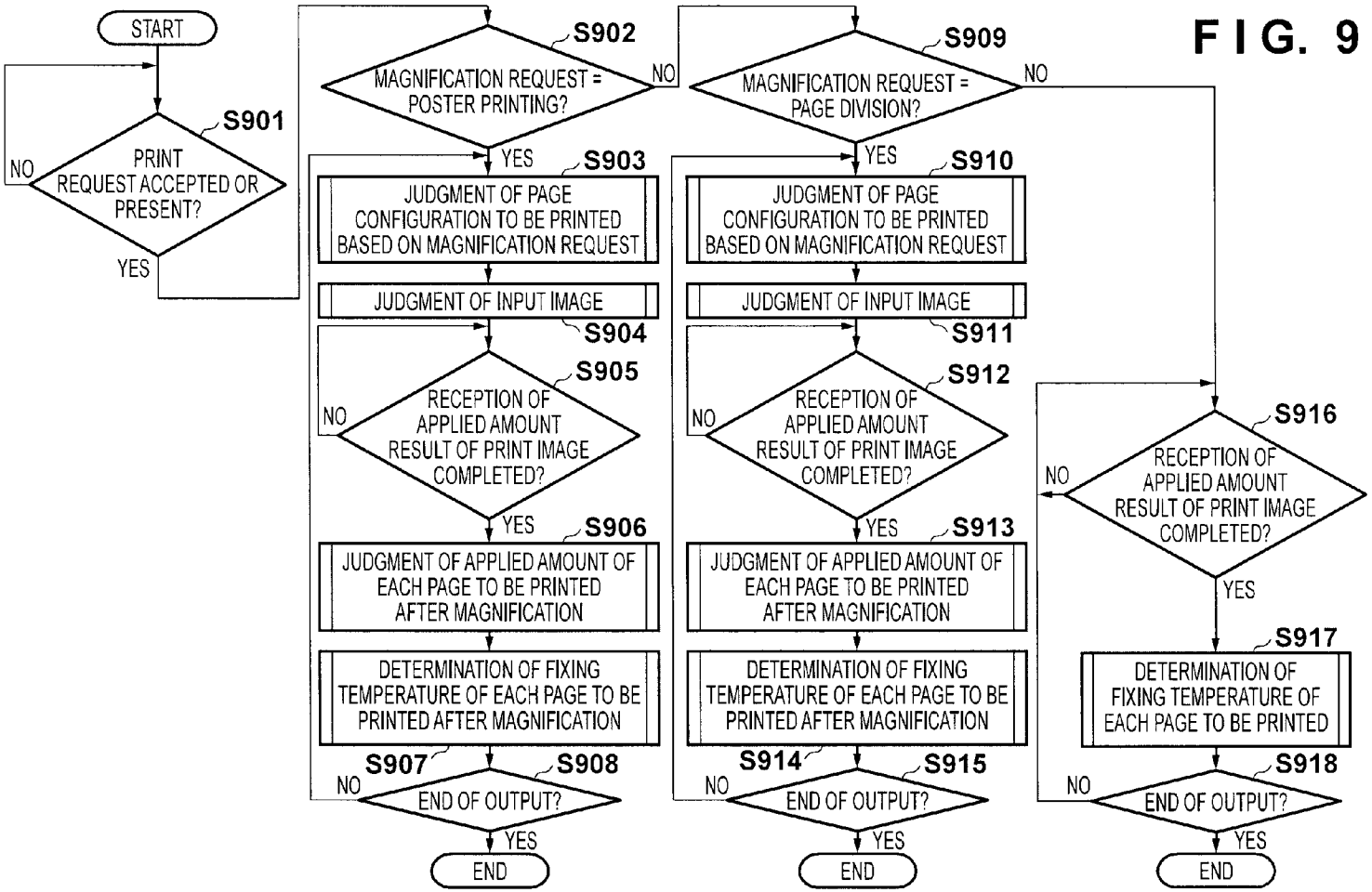
FIG. 9 is a flowchart showing a fixing temperature determination method in the controller unit.
Figure 10:
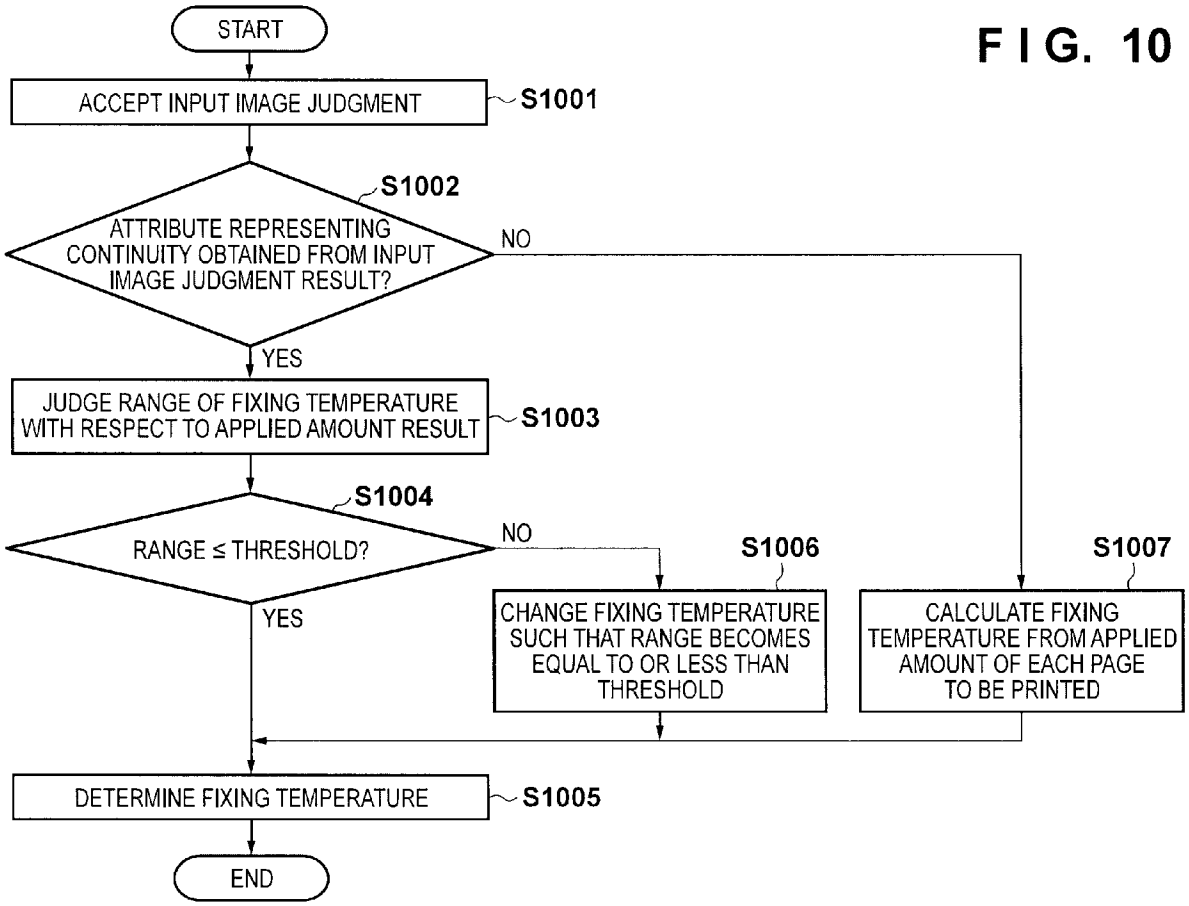
FIG. 10 is a flowchart showing a fixing temperature determination method in a print unit.

FIGS. 9 and 10 explain fixing temperature control processing using an applied toner amount detection result of the image forming apparatus 101 according to the first embodiment. FIG. 9 shows processing to be executed under the control of the CPU 304 of the controller unit 301. FIG. 10 shows processing to be executed under the control of the CPU 315 of the print unit 302.

Processing to be executed under the control of the CPU 304 of the controller unit 301 will be described first with reference to FIG. 9. In step S901, the CPU 304 receives a print request from the UI unit 324.

In step S902, the CPU 304 determines whether the printout request is "poster printing" (output format determination unit). If the printout request is poster printing, the process advances to step S903. If the printout request is not poster printing, the CPU 304 determines in step S909 whether the printout request is "page division printing". If the printout request is not page division printing, the CPU 304 determines that the printout request is normal print printing, and the process advances to step S916. In this case, in step S916, the CPU 304 controls the fixing temperature upon receiving the calculation result of an amount of applied toner for each image region of the input image corresponding to the arrangement position of each of the plurality of pages to be printed.

In step S917, the CPU 304 determines the fixing temperature of each page in accordance with the image configuration for printout (temperature determination unit). When fixing temperatures are determined for all printouts, the processing ends in step S918.

In step S903, the CPU 304 determines the image configuration of each page in accordance with the configuration of image layout to be printed. For example, at the time of 2×2 poster printing setting, image layout configuration of each page when the image is enlarged to 2×2 from the input image data is determined.

In step S904, the CPU 304 determines the continuity of the input image with respect to the image layout configuration of each page of the printout determined in step S903. The CPU 304 determines whether each page has a continuous image or an independent image, and adds the determination result to each page of the target printout as attribute information.

In step S905, the CPU 304 receives the calculation result of the amount of applied toner to the image data to be printed. In step S906, based on the applied toner amount result in step S905, the CPU 304 calculates the amount of applied toner of each page with respect to the image layout to be printed which is determined in step S902. For example, in an image layout configuration that prints input image data as an image enlarged to 2×2, the amount of applied toner calculated from the input image data (one page) is uniformly given to a total of four pages of output images that are 2×2 printouts. Alternatively, the input image data is divided into four regions according to the image layout configuration (in this case, 2×2=4-way division) to be printed, and the amount of applied toner is calculated for each of the divided regions. The calculated amount of applied toner is set for the output image of a corresponding printout page.

In step S907, based on the calculation result of the amount of applied toner of each page in step S906 and the image attribute information determined in step S904, the CPU 304 determines the fixing temperature of each page to be printed. The information of the fixing temperature determined in step S907 is sent to the CPU 315.

Note that upon determining in step S909 that the printout request is "page division printing", the process advances to step S910 to determine the image configuration of each page in accordance with the image layout configuration to be printed. For example, when 2×2 page division printing is set, image configuration of each page when the image is enlarged to 2×2 from the input image data is determined.

In step S911, the CPU 304 determines the region to be divided in accordance with the setting of page division printing for the image layout configuration of each page determined in step S910. In the page division printing processing, the region of each image is determined to be an independent image. The determination result is added to each target page as attribute information. In this case, the attribute information represents that the image characteristics of the pages are "discontinuous".

In step S912, the CPU 304 receives the calculation result of the amount of applied toner to the image data to be printed. In step S913, based on the applied toner amount result in step S912, the CPU 304 calculates the amount of applied toner of each page with respect to the image layout configuration to be printed which is determined in step S909. For example, in an image configuration that prints input image data as an image enlarged to 2×2 by "page division printing", the input image data is divided into four regions according to the image layout configuration (in this case, 2×2=4-way division) to be printed, and the amount of applied toner is calculated for each of the divided regions. The calculated amount of applied toner is set for the output image of a corresponding printout page.

In step S914, based on the calculation result of the amount of applied toner of each page in step S913 and the image attribute information determined in step S911, the CPU 304 determines the fixing temperature of each page to be printed.

Processing to be executed under the control of the CPU 315 of the print unit 302 will be described next with reference to FIG. 10. The CPU 315 finally determines the fixing temperature based on the attribute information and the information of the fixing temperature determined by the processing shown in FIG. 9 and the threshold result of the fixing temperature threshold determination unit 326.

In step S1001, the CPU 315 accepts the determination result of the configuration of input image data. Here, the "determination result" is the processing result in step S904 described above. In step S1002, the CPU 315 refers to the attribute information of the input image data. Upon determining based on the result of image continuity represented by the attribute information that the input image data has continuity, the process advances to step S1003. Otherwise, the process advances to step S1007.

In step S1003, the CPU 315 determines, based on the applied toner amount result, the threshold of the fixing temperature for the image data to be printed. The "applied toner amount result" is the result of the amount of applied toner detected by the applied toner amount detection unit 311. From the applied toner amount information and the image attribute information, the fixing temperature threshold determination unit 326 calculates the threshold of the fluctuation width of the fixing temperature (temperature difference threshold) for each page of the image data to be printed. For example, upon determining that the size is 2×2, and the pages have image continuity, control is done so that the difference between the fixing temperatures of the 2×2 pages (a total of four pages) does not become too large (temperature determination unit). In this case, the fixing temperature of each page is determined such that the fixing temperature difference is a predetermined threshold or less (within the temperature difference threshold). For example, when the fixing temperature difference capable of maintaining image quality is 1° C. or less between the printouts of the plurality of pages, the fixing temperature threshold determination unit 326 outputs, to the CPU 315, a predetermined threshold with which the difference between the calculated values of the fixing temperatures becomes 1° C. or less.

In step S1004, the CPU 315 calculates the fixing temperature of each page to be printed. In step S1005, the CPU 315 performs determination so that when calculating the fixing temperatures, the fixing temperature difference between all pages to be printed becomes equal to or less than the fixing temperature threshold determined in step S1003. The fixing temperature determination method will be described later with reference to FIG. 11. Note that when the fixing temperature of each page calculated from the amount of applied toner exceeds the predetermined threshold, the value of the fixing temperature of at least one page is changed so that the fixing temperature becomes equal to or less than the predetermined threshold (step S1006).

In step S1007, the CPU 315 calculates the fixing temperature according to the amount of applied toner of each page in the image layout configuration of the printout based on the determination result in step S1002. In this case, the fixing temperatures of the pages of the printout are independently controlled.

In step S1005, the CPU 315 determines the fixing temperature of fixing to be performed by the fixing unit 320 based on the fixing temperatures calculated in steps S1006 and S1007. The information of the determined fixing temperature is sent to the fixing temperature control unit 319. The fixing temperature control unit 319 executes fixing temperature control so that the fixing temperature determined for each page is obtained at the time of fixing processing of each page.

Figure 12:
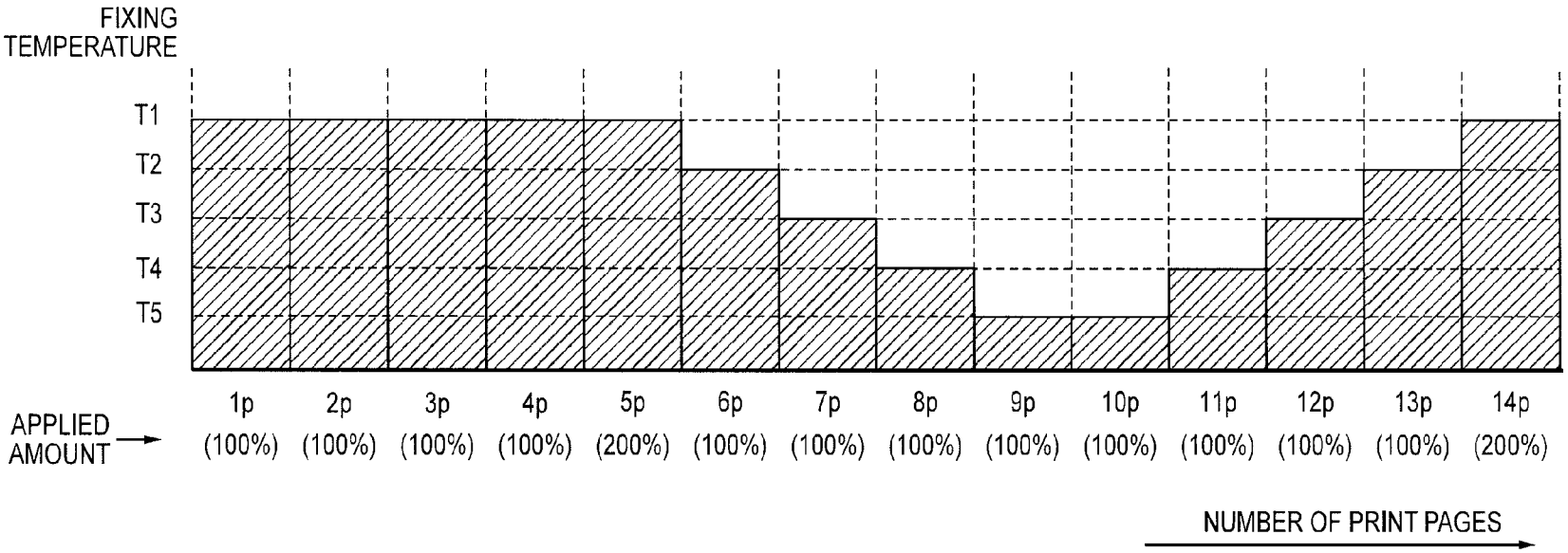
FIG. 12 is a view showing an example of fixing temperature control at the time of printing of the image forming apparatus.

FIG. 12 is a graph showing an example of fixing temperature control at the time of printing of the image forming apparatus. The abscissa represents the number of pages to be printed, and the ordinate represents the fixing temperature when fixing the page. Note that the amount of applied toner of each page is shown under the number of pages. FIG. 12 shows an example in which data of 14 pages are received, the amounts of applied toner of the fifth page and the 14th page are 200%, and the amounts of applied toner of the remaining pages are 100%. Note that in the image forming apparatus 101, the relationship between the amount of applied toner and the minimum temperature necessary for fixing is the same as shown in FIG. 7. That is, the temperature necessary for fixing an image whose amount of applied toner is 200% is T1. The temperature necessary for fixing an image whose amount of applied toner is 100% is T5 (T5<T1).

For example, when "poster printing processing" is designated, and the same fixing temperature is set for the pages to be printed, the fixing temperature control of pages 1 to 5 in FIG. 12 is performed. When the pages of printout are independent, and the fixing temperatures are calculated from the amounts of applied toner of the pages, control is performed such that a fixing temperature value calculated for each page is obtained as indicated by the sixth to 14th pages in FIG. 12.

With the above-described control, it is possible to perform temperature control of the fixing unit according to the amount of applied toner without lowering the productivity and reduce the power consumption.

<Fixing Temperature Determination Processing Reflecting Fixing Temperature Threshold>

Figure 11:
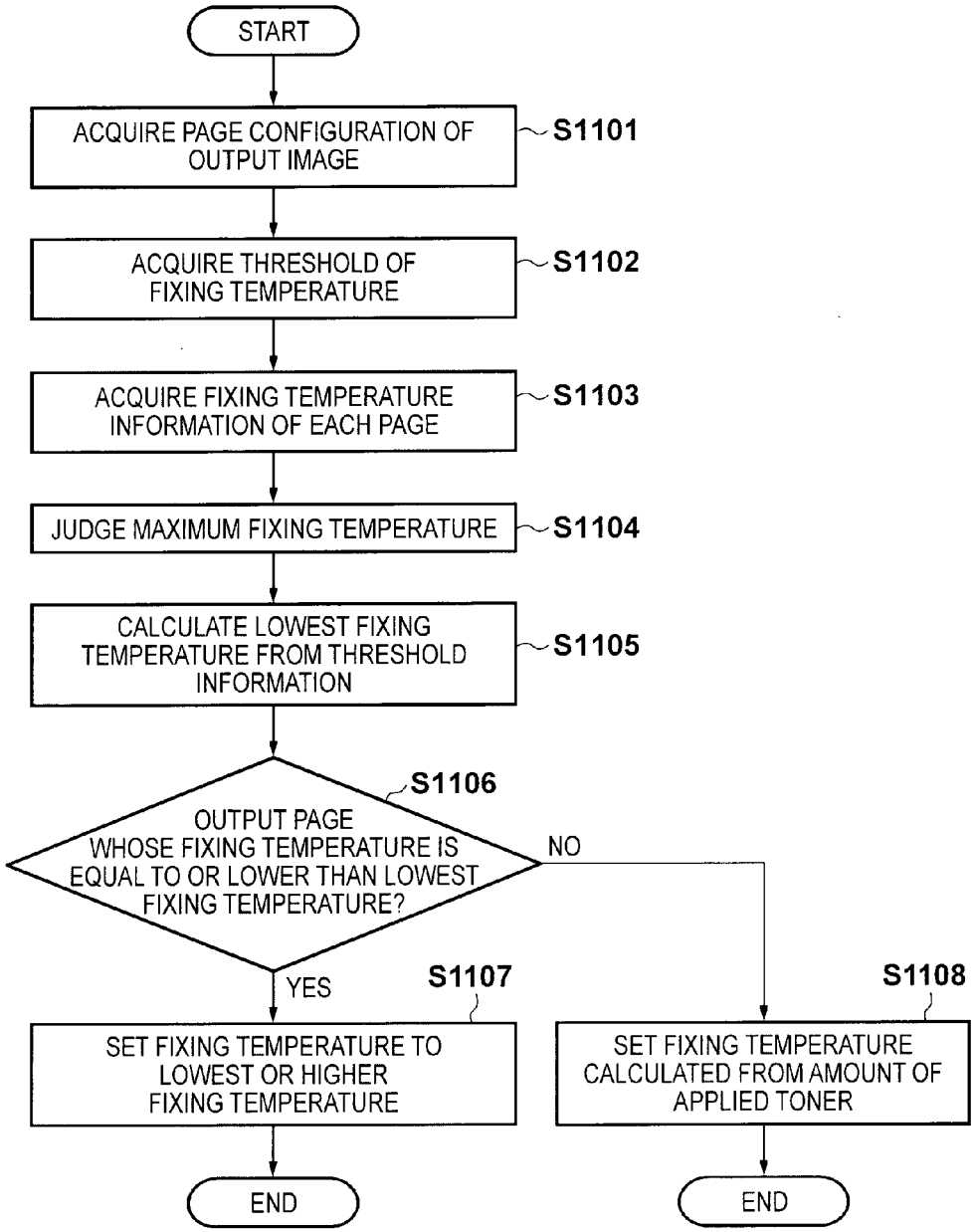
FIG. 11 is a flowchart showing details of the fixing temperature determination method.

FIG. 11 is a flowchart showing details of the fixing temperature determination method. In step S1101, the CPU 304 acquires the configuration information of printout pages. In step S1102, the CPU 315 acquires the information of the threshold determined by the fixing temperature threshold determination unit 326. In step S1103, the CPU 315 acquires, from the CPU 304, the information of the fixing temperature of each page to be printed.

In step S1104, the CPU 315 determines the fixing temperature of the page having the highest fixing temperature in the pages to be printed. More specifically, the CPU 315 selects the fixing temperature having the maximum value out of the plurality of fixing temperatures calculated from the amounts of applied toner of the pages to be printed.

In step S1105, the CPU 315 calculates, based on the value of the threshold of the fixing temperature and the value of the highest fixing temperature determined in step S1104, the lowest fixing temperature in the pages to be printed. The lowest fixing temperature is obtained by subtracting the value of the threshold determined by the fixing temperature threshold determination unit 326 from the value of the highest fixing temperature. In addition, the difference between the highest fixing temperature and the lowest fixing temperature is determined to be equal to or less than the above-described value of the threshold.

In step S1106, the CPU 315 determines whether there is a page for which a fixing temperature having a value smaller than the lowest fixing temperature calculated in step S1105 is set. If such a page does not exist, in step S1108, the CPU 315 determines the original fixing temperature calculated from the amount of applied toner as the fixing temperature to be used. If such a page exists, in step S1107, the CPU 315 determines the lowest or higher fixing temperature calculated in step S1105 as the fixing temperature of the page of interest. The fixing temperature of each page to be printed can thus be determined using the threshold of the fixing temperature.

<Example of Printout Data Generation and Fixing Temperature Calculation Processing>

An example in which 2×2 enlargement printing (in this case, both poster printing processing and page division processing) is executed for the input image of one page will be described here.

Figure 13:
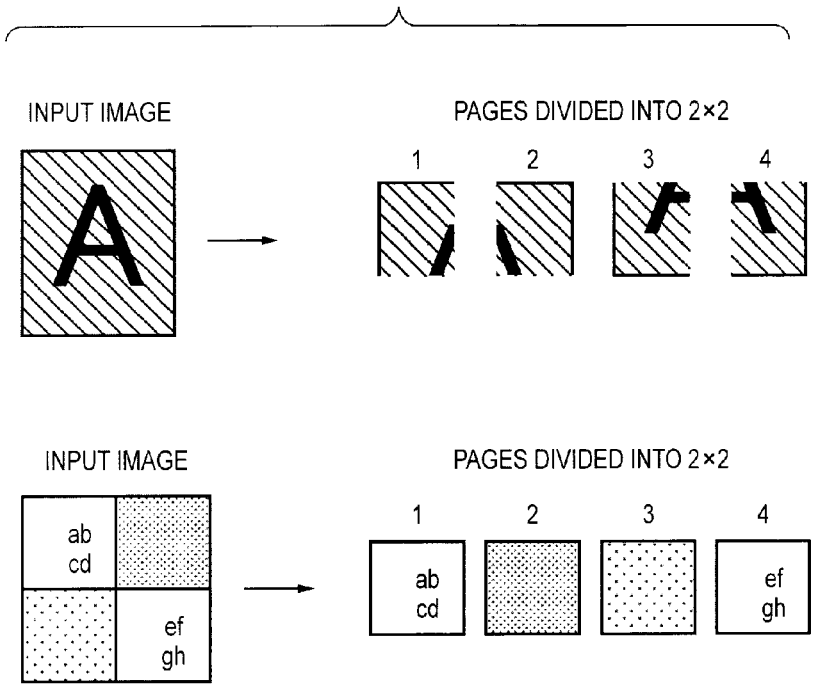
FIG. 13 is a view exemplarily showing image division according to the first embodiment.

The upper view of FIG. 13 shows an example in which 2×2 "poster printing" is executed for an input image. First, the input image is determined as "poster printing", and the regions of four divided images are determined to be "continuous". Next, the input image is divided into four images (images 1, 2, 3, and 4 shown in the upper view of FIG. 13), and the amount of applied toner is calculated for each of the divided image regions.

The fixing temperature is determined based on the amount of applied toner calculated for each of the divided image regions. That is, the fixing temperature is determined based on the amount of applied toner for each of the divided images 1, 2, 3, and 4 shown in the upper view of FIG. 13. The determined fixing temperatures are T1, T2, T3, and T4 corresponding to the images 1, 2, 3, and 4 shown in the upper view of FIG. 13, respectively.

Since the divided image regions 1, 2, 3, and 4 are determined as continuous regions, final fixing temperatures for the image regions 1, 2, 3, and 4, which reflect the information of the threshold of the fixing temperature (above-described predetermined threshold), are determined in correspondence with the fixing temperatures T1, T2, T3, and T4 determined previously. The threshold of the fixing temperature is set as a maximum temperature T of the fixing temperature difference between the pages to be printed.

Examine a case where the fixing temperatures T1, T2, T3, and T4 of the image regions satisfy a relationship T1>T2>T4>T3 and the fixing temperature threshold T satisfies a relationship T4>T1−T>T3. The fixing temperature threshold T is a constraint condition to suppress the temperature difference from a region of a high fixing temperature within a certain region. In this case, the fixing temperature T3 of the image region 3 does not meet the constraint condition of the fixing temperature threshold T. That is, the fixing temperature T3 is low and cannot meet the constraint of the fixing temperature threshold T unless it remains equal to or more than T4 (falls below the lowest fixing temperature). Hence, T4 is changed by correcting the fixing temperature T3 of the image region 3. As a result, the final fixing temperatures of the four divided image regions (corresponding to the images 1, 2, 3, and 4 shown in the upper view of FIG. 13) of the input image are T1, T2, T4, and T4, respectively.

The lower view of FIG. 13 shows an example in which 2×2 "page division printing" is executed for an input image. First, the input image is determined as "page division printing". Because of page division printing, the regions of four divided images of the input image are determined to be "independent" and "discontinuous". Next, the input image is divided into four images (images 1, 2, 3, and 4 shown in the lower view of FIG. 13), and the amount of applied toner is calculated for each of the divided image regions.

The fixing temperature is determined based on the amount of applied toner calculated for each of the divided image regions. The determined fixing temperatures are T1, T2, T3, and T4 corresponding to the images 1, 2, 3, and 4 shown in the lower view of FIG. 13, respectively. Since the divided image regions are independent, evaluation of each fixing temperature using the above-described fixing temperature threshold is not performed. That is, the fixing temperatures T1, T2, T3, and T4 are determined as the final fixing temperatures.

As described above, according to the first embodiment, it is possible to appropriately adjust the fixing temperature in accordance with the amount of applied toner. Especially when printing output images of a plurality of pages from input image data of one page, the fixing temperature can more appropriately be adjusted in accordance with "poster printing" or "page division printing". This control makes it possible to further reduce the power consumption while guaranteeing the image of output image data.

(Second Embodiment)

In the above-described first embodiment, the amount of applied toner and the fixing temperature are controlled for each image region divided in accordance with the configuration of the output image at the time of both "poster printing" setting and "page division printing" setting. In the second embodiment, a form will be described in which a uniform fixing temperature is set for all pages to be printed at the time of "poster printing" setting. Note that fixing temperature calculation control of the image forming apparatus is almost the same as in the first embodiment (FIG. 9), and only different portions will be explained.

Figure 14:
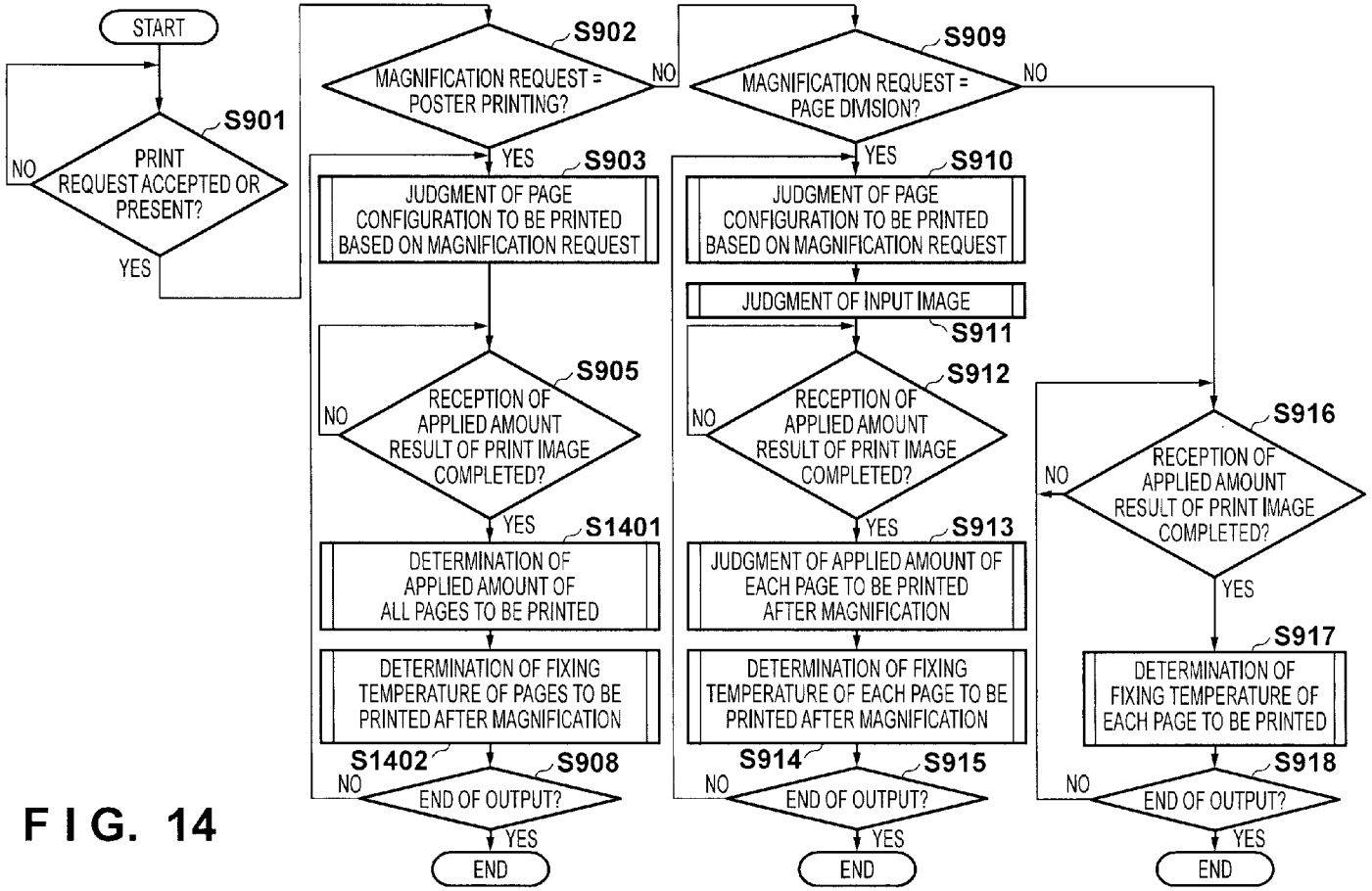
FIG. 14 is a flowchart showing the fixing temperature determination method of an image forming apparatus according to the second embodiment.

FIG. 14 is a flowchart showing the fixing temperature determination method of an image forming apparatus according to the second embodiment. First, at the time of determining that "poster printing" is designated, the image to be printed is determined to be "continuous", and the process of step S904 is omitted.

In step S1401, a CPU 304 determines to make uniform the fixing temperatures of all pages of the image to be printed. To do this, the CPU 304 calculates, from the input image data, the amount of applied toner for all image regions (all four pages) to be printed. That is, in the first embodiment, the amounts of applied toners are individually calculated for the pages. In the second embodiment, however, one common applied toner amount result is calculated for all pages.

In step S1402, the CPU 304 determines the fixing temperature for printout. In this case, since one common applied toner amount result is calculated for all pages, a fixing temperature determination using a fixing temperature threshold is unnecessary, unlike the first embodiment. The fixing temperature is calculated based on the amount of applied toner calculated in step S1401. The calculated fixing temperature is a uniform value common for all pages to be printed. Note that the fixing temperature is a uniform value common for all pages, as expressed above. In fact, it is only necessary to make the width (difference) between the fixing temperatures of the plurality of pages equal to or less than a predetermined value, and the fixing temperatures need not always completely match.

As described above, according to the second embodiment, it is possible to appropriately adjust the fixing temperature in accordance with the amount of applied toner. Especially when "poster printing" is designated, it is possible to further reduce the power consumption while guaranteeing the image of output image data.

In the first and second embodiments, toner has been exemplified as a recording material. However, it may be ink.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-237357, filed Nov. 15, 2013, which is hereby incorporated by reference herein in its entirety.

What is claimed is:

1. An image forming apparatus for controlling, in accordance with an amount of recording material for image data, a fixing temperature for fixing a recording material on a sheet, comprising:

a control unit configured to (i) control, if a setting of printing image data of one page on one sheet is done, the fixing temperature on a per-sheet basis by using a fixing temperature corresponding to an amount of recording material obtained from the image data of one page, and to (ii) control, if a setting of dividing image data of one page and printing the image data of one page on a plurality of sheets is done, the fixing temperature so that fixing temperatures for the plurality of sheets are to be the same; and a fixing unit configured to fix a recording material on a sheet based on the fixing temperature controlled by the control unit.

2. The apparatus according to claim 1, wherein the control unit determines, if a setting of dividing the image data of one page and printing the image data on the plurality of sheets is done, the fixing temperature based on at least one of a plurality of divided image data.

3. The apparatus according to claim 1, wherein the control unit determines, if a setting of dividing the image data of one page and printing the image data on the plurality of sheets is done, one fixing temperature from amounts of recording material obtained from each of a plurality of divided image data.

4. The apparatus according to claim 1, wherein the amount of the recording material for the image data is a total sum of toner amounts of toner of cyan, magenta, yellow, and black per unit area of the image data.

5. The apparatus according to claim 1, wherein the setting of dividing image data of one page and printing the image data of one page on a plurality of sheets comprises a poster printing setting.

6. An image forming apparatus for controlling, in accordance with an amount of recording material for image data, a temperature of a fixing unit configured to fix a recording material on a sheet, comprising:

an acquisition unit configured to acquire an amount of recording material for image data of one page; and a control unit configured to control the temperature of the fixing unit on a per-sheet basis by using the amount of recording material obtained by the acquisition unit, wherein, if a setting of dividing image data of one page and printing the image data of one page on a plurality of sheets is done, the control unit does not control the temperature of the fixing unit on a per-sheet basis, and controls the fixing unit so that fixing temperatures for the plurality of sheets are to be the same.

7. A control method of an image forming apparatus for controlling, in accordance with an amount of recording material for image data, a fixing temperature for fixing a recording material on a sheet, comprising the steps of:

controlling, if a setting of printing image data of one page on one sheet is done, the fixing temperature on a per-sheet basis by using a fixing temperature corresponding to an amount of recording material obtained from the image data of one page;

controlling, if a setting of dividing image data of one page and printing the image data of one page on a plurality of sheets is done, the fixing temperature so that fixing temperatures for the plurality of sheets are to be the same; and fixing a recording material on a sheet based on the fixing temperature controlled by the controlling steps.

8. A non-transitory computer-readable recording medium storing a program that causes a computer to function as each of the units of an image forming apparatus for controlling, in accordance with an amount of recording material for image data, a fixing temperature for fixing a recording material on a sheet, comprising:

a control unit configured to (i) control, if a setting of printing image data of one page on one sheet is done, the fixing temperature in a per-sheet basis by using a fixing temperature corresponding to an amount of recording material obtained from the image data of one page, and to (ii) control, if a setting of dividing image data of one page and printing the image data of one page on a plurality of sheets is done, the fixing temperature so that fixing temperatures for the plurality of sheets are to be the same; and a fixing unit configured to fix a recording material on a sheet based on the fixing temperature controlled by the control unit.

* * * * *